US005364100A

United States Patent [19]

Ludlow et al.

[11] Patent Number: 5,364,100

[45] Date of Patent: Nov. 15, 1994

[54] GAMING APPARATUS

[75] Inventors: Roy A. G. Ludlow; Ramon De Beneducci, both of Langley Mill, England

[73] Assignee: Project Design Technology Limited, Nottingham, England

[21] Appl. No.: 1,832

[22] Filed: Jan. 8, 1993

[51] Int. Cl.[5] ..... A63F 5/04

[52] U.S. Cl. ..... 273/143 R

[58] Field of Search ..... 273/143

[56] References Cited

U.S. PATENT DOCUMENTS 3,642,287 2/1972 Lally et al. ..... 273/143 R

FOREIGN PATENT DOCUMENTS

3105266A1 2/1981 Germany ..... G07F 17/34
1262134 1/1969 United Kingdom ..... A63F 5/04
1464896 1/1974 United Kingdom ..... G07F 17/34

*Primary Examiner*—Paul E. Shapiro
*Attorney, Agent, or Firm*—W. Thad Adams, III

[57] ABSTRACT

In a gaming machine having a set of reels (8) with fruit symbols equi-spaced around their peripheral edges, two of the reels (8) may each be provided with a shield (10) which would normally conceal the respective symbols from the player's view through the machine window. After a play when the reels (8) have stopped rotating, the player can select to reveal the symbol concealed by either or both shields (10), by moving the respective shield (10) which is pivotally mounted on the respective reel. Identification markings on each shielded reel (8) are always visible to the player to reassure the player that when the reveal facility is used no further rotation of the respective reel (8) takes place. The revealed symbol is combined with the other visible symbols to determine whether or not there is a winning combination.

4 Claims, 2 Drawing Sheets

GAMING APPARATUS

This invention is concerned with gaming apparatus, i.e. apparatus for playing a game of chance, one commonly known type of which is a fruit machine.

According to the present invention there is provided apparatus for playing a game off chance, said apparatus including a plurality of symbol presentation means, each having a plurality of symbols, at least one of which, in use, is randomly selected to be positioned for viewing by a player of the game, identification means provided on at least one of the symbol presentation means, shield means operatively associated with said one symbol presentation means and positioned to shield said one symbol when the latter is in the viewing position but adapted to enable viewing of the identification means, the player being able to control movement of the shield means to reveal said one symbol to the player, whereby the player can ensure that no movement of the shielded symbol takes place during movement of the shield means, the combination of the revealed symbol and some or all of those symbols of the other symbol presentation means in their viewing positions determining whether the player is entitled to a prize.

Each symbol presentation means may take the form of a reel and the shield means may comprise a cover which is pivotally mounted on the axis of the reel. The identification means may comprise peripheral markings on the reel, and cut-outs may be provided on the cover to enable viewing of the peripheral markings therethrough.

An embodiment of the present invention will now be described by way of example only, with reference to the accompanying drawings, in which.

A gaming machine comprises a set of reels, preferably four, each of which has a plurality of symbols, for example representative of different kinds of fruit, equi-spaced around its peripheral edge. The reels are separately mounted to be rotatable relative to one another in a conventional fashion when the machine is operated and the stop positions of the reels may be randomly predetermined with means being provided for stopping the reels where desired. A combination of at least symbols of three of the reels visible through respective windows of the machine when the reels have slopped rotating generally determines whether or not the player should receive a prize. Such a gaming machine can present a number of different play facilities which may be randomly available to the player.

Figure 2:
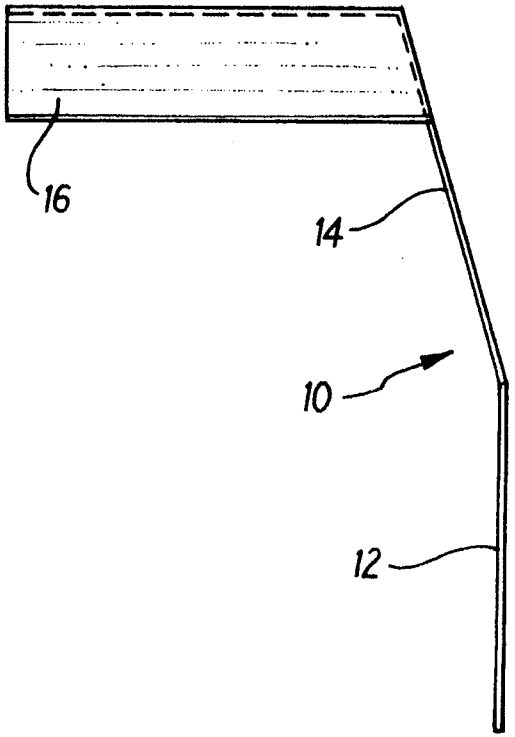
FIG. 2 is an end elevation of the component of FIG. 1.
Figure 1:
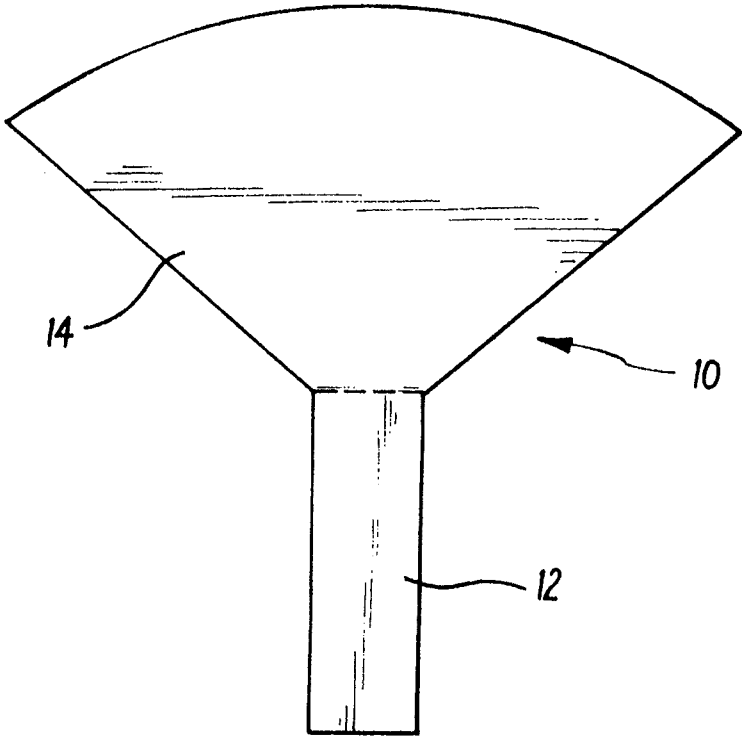
FIG. 1 is a side elevation of a component of the apparatus according to the invention.
Figure 3:
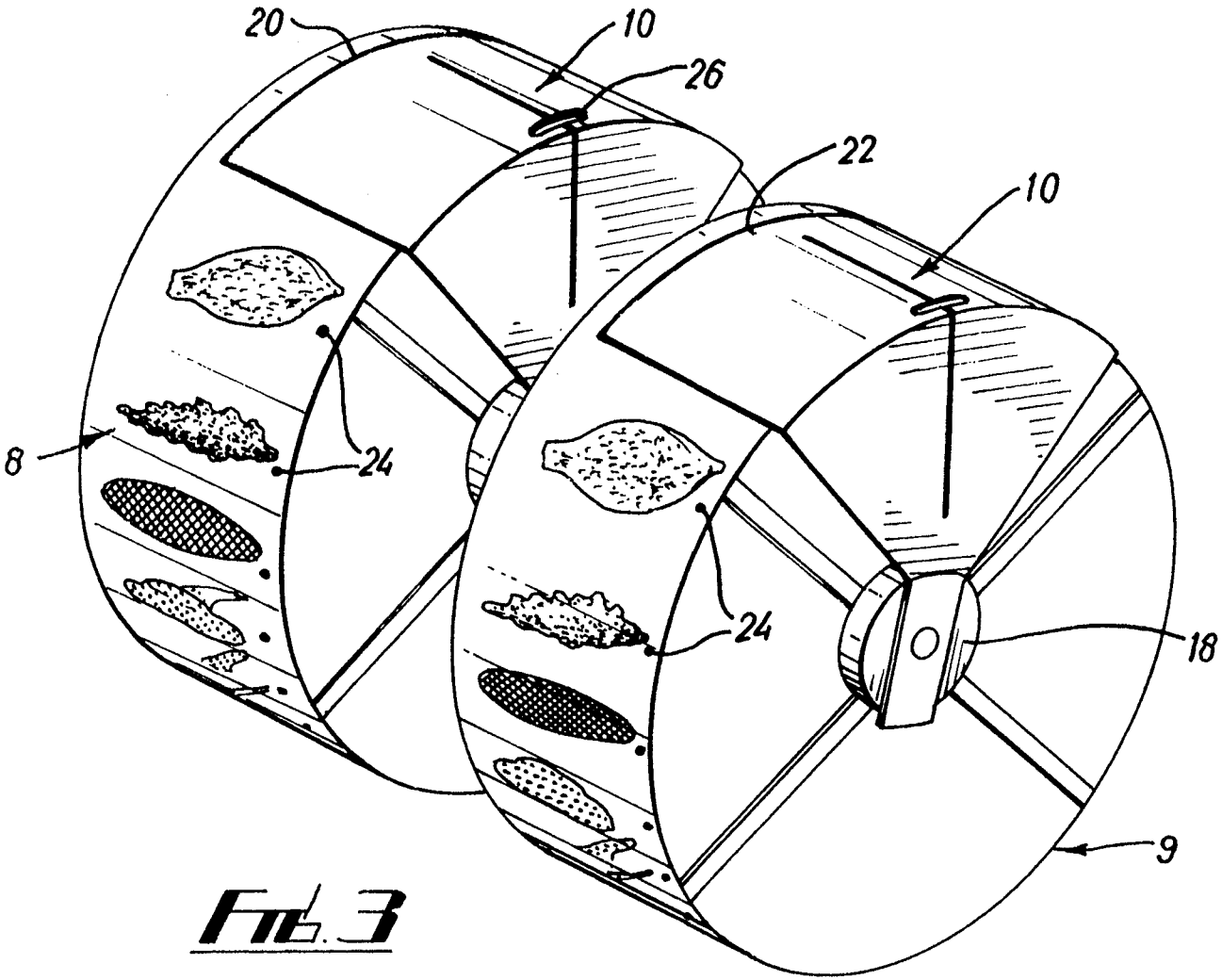
FIG. 3 is a perspective view showing the component in use.

The present embodiment of the apparatus provides for the symbol on each of two of the reels to be concealed in normal play from the view of the player. Referring to the drawings, two of the reels are shown in FIG. 3, i.e. reels 8, 9, each having the facility of symbol concealment by means of a shield 10. As shown in FIGS. 1 and 2, the shield 10 has a mounting leg 12 pivotally mounted adjacent one end thereof on an axis of the respective reel, and an arcuate cover 14 stepped to one side of the leg 12 and radiussed to be concentric with the periphery of the respective reel whereby a section 16 can overlie the latter.

After a play, when the reels have stopped rotating, the player can select to reveal the symbol 20 located underneath the section 16 on the reel 8 by pressing an appropriate button to effect pivoting of the shield 10.

Movement of the shield 10 may be effected by means of a stepping motor 18. The revealed symbol is then combined with the other visible symbols by the machine to determine whether or not there is a winning combination. The symbol 22 underneath the section 15 on the reel 9 may be similarly revealed if required.

It is important for the player to be reassured that when the reveal facility is used, no further rotation of the respective reel 8 or 9 takes place. For this purpose, each reel 8, 9 is provided with identification markings at the respective symbol locations, for example a dot 24 provided on the reel periphery at the side of each of the symbols. Alternatively, the markings could be in the form of slots (not shown). A cutout 26 is provided on the shield section 16, and correspondingly the respective window of the machine may be provided with a cut-out so located that the peripheral identification dot 24 at the symbol location which stops under the shield section 16 can be viewed through both the shield 10 and the window. In this way, when the player elects to move the shield 10 the player can also see that no change of the symbol location has taken place.

The reveal facility can thereby increase the options open to the player and enhance the enjoyment of the game. It will be appreciated that the facility may be appropriate to a gaming machine having symbols representative of other than kinds of fruit. For example, the facility may be particularly advantageous for a machine where the symbols are representative of playing cards, with the player playing a game of pontoon. The reveal facility in this case would be equivalent to the provision of one or more additional cards, i.e. "twisting", in an attempt to obtain a winning hand.

Various modifications may be made without departing from the invention. For example, a shield may be provided for any selected one of the reels, and the reveal facility may be used in a gaming machine with other than four reels. Also, the reveal facility may be provided by apparatus other than that specifically described and shown and can be available on types of games other than those described.

We claim:

1. Apparatus for playing a game of chance, said apparatus including a plurality of symbol presentation means, each having a plurality of symbols, at least one of which, in use, is randomly selected to be positioned for viewing by a player of the game, identification means provided on at least one of the symbol presentation means, shield means operatively associated with said one symbol presentation means and positioned to shield said one symbol when the latter is in the viewing position but adapted to enable viewing of the identification means, the shield means being movable by the player to reveal said one symbol to the player, whereby the player can ensure that no movement of the shielded symbol takes place during movement of the shield means, the combination of the revealed symbol and some or all of those symbols of the other symbol presentation means in their viewing positions determining whether the player is entitled to a prize.

2. Apparatus according to claim 1, wherein each symbol presentation means takes the form of a reel, the shield means comprising a cover which is pivotally mounted on the axis or the reel.

3. Apparatus according to claim 2, wherein the identification means comprises peripheral markings on the reel.

4. Apparatus according to claim 3, wherein cut-outs are provided on the cover to enable viewing of the peripheral markings therethrough.

* * * * *